United States Patent [19]

Knappstein et al.

[11] 4,247,366

[45] Jan. 27, 1981

[54] METHOD OF OPERATING A COAL PREDRYING AND HEATING PLANT IN CONNECTION WITH A COKING PLANT

[75] Inventors: Johannes Knappstein; Dieter Stalherm; Janos Bocsancźy, all of Recklinghausen, Fed. Rep. of Germany

[73] Assignee: Firma Carl Still, Fed. Rep. of Germany

[21] Appl. No.: 897,375

[22] Filed: Apr. 18, 1978

[30] Foreign Application Priority Data

Apr. 29, 1977 [DE] Fed. Rep. of Germany ..... 2719189

[51] Int. Cl.[3] ..... C01B 57/10

[52] U.S. Cl. ..... 201/41; 110/232; 202/150; 432/14

[58] Field of Search ..... 201/41; 202/262, 150; 110/232; 432/14, 16, 58, 13

[56] References Cited

U.S. PATENT DOCUMENTS

| | | | |
|---|---|---|---|
| 958,184 | 5/1910 | Schulte | 201/39 |
| 1,941,130 | 12/1933 | Weeks et al. | 202/262 |
| 2,408,810 | 10/1946 | Puening | 202/262 X |
| 3,047,473 | 7/1962 | Schmidt | 202/262 X |
| 3,374,151 | 3/1968 | Schmidt | 202/262 X |
| 3,457,141 | 7/1969 | Schmidt | 202/262 X |
| 3,992,266 | 11/1976 | Aktay et al. | 201/41 X |
| 3,997,299 | 12/1978 | von Linde et al. | 55/255 X |
| 4,024,024 | 5/1977 | Knappstein | 202/262 |
| 4,053,364 | 10/1977 | Poersch et al. | 201/39 X |

FOREIGN PATENT DOCUMENTS

| | | | |
|---|---|---|---|
| 2415758 | 2/1976 | Fed. Rep. of Germany | 201/41 |
| 2647079 | 4/1978 | Fed. Rep. of Germany | 201/41 |

*Primary Examiner*—Frank W. Lutter
*Assistant Examiner*—Roger F. Phillips
*Attorney, Agent, or Firm*—McGlew and Tuttle

[57] ABSTRACT

A method of preparing and delivering coal to a coking plant, comprises, conveying the coal to the plant on a moving conveyor while an inert combustion gas is directed over the coal being conveyed. The combustion gas is generated by burning a fuel with air to produce a substantially inert combustion gas which is passed over the coal during its conveying and, thereafter, passed through a cooler for removing the moisture which has been picked up from the coal by the gas. The heating and predrying inert gases are advantageously generated by the direct combustion of air and fuel which are passed through flash dryer tubes and one or more separate separator systems and then delivered into a conveyor pipeline through which the coal is conveyed. A portion of the gases which are generated are also directed with a return gas to a filter for removal of any coal therefrom and to a cooler for removing the moisture picked up from the coal and then back into the stream for delivery to the conveyor for the coal. The inert gas may also be a gas which is circulated in heat exchange relationship with combustion gases which are generated by a combustion of the coal itself. In such a system, a portion of the combustion gases generated are also passed through a condenser or cooler and the cooled and dried waste gases are circulated over the coal being conveyed to the coking oven or its bunkers.

8 Claims, 2 Drawing Figures

METHOD OF OPERATING A COAL PREDRYING AND HEATING PLANT IN CONNECTION WITH A COKING PLANT

FIELD AND BACKGROUND OF THE INVENTION

This invention relates in general to the operation of coking ovens and, in particular, to a new and useful method of operating a coal predrying and heating plant or for preparing and delivering coal to a coking plant in which the coal to be carbonized is passed through driers where it is brought into direct contact with an inert drying gas which is produced by the combustion of a fuel with air and, wherein, the preheated coal is separated from the drying and heating gas and transported under the protective cover of an inert gas to the oven chambers of a coke oven battery or to the bunkers serving the battery.

DESCRIPTION OF THE PRIOR ART

A method is known, for example, from German Offenlegungsschrift No. 2,415,758. For use as inert drying and protective gases, gases may be used which are comprised entirely or partly of carbon dioxide, nitrogen or steam. An inert gas is required not only for operating the drying plant, but also as a protective cover of inert atmosphere, because of the high temperature of about up to 240° C. to which the coal is preheated and, consequently, the necessity of protecting the coal from being oxidized by the atmospheric oxygen during the transportation to the oven chambers or bunkers of the coke oven battery.

Inert waste gases are not available for this purpose and, in such cases, an inert gas, for example, nitrogen, must be produced and made available by separation from air, and if the oxygen of the separator cannot be used for other purposes, for example, in a metallurgical plant, the coking process is economically and technologically handicapped by the expensive production of nitrogen.

SUMMARY OF THE INVENTION

The present invention is directed to the solution of this problem and, to this end, the invention provides for the use of combustion gases produced during the heating of the circulated predrying and heating gases, after their cooling and separation, as the inert gas for the protective covering.

During such a coal drying and heating process, combustion gases are continuously produced since a fuel must be burned for the heating of the drying gases. The economy of the provided method results from the fact that a separate production of inert gas is no longer necessary, since waste gases which must be produced in any event are used.

If the circulated gas for predrying and preheating is heated directly, the amount in excess of the produced combustion gas in the circuit is branched off and, after an appropriate treatment, is used for covering the preheated coal during the further transportation thereof. The amount of the combustion gas is always sufficient for the use in accordance with the invention. If the drying and heating gas is heated indirectly, the gas circuit for the drying and preheating of the coal and the paths of the combustion gas used as inert gas protecting the hot coal during the transportation thereof are completely separated from each other.

In a particular modification of the method, steam is used as the circulated drying and heating gas. Since the moisture of the coal is evaporated from it during the drying process, steam in excess is obtained in an amount corresponding to the moisture content of the coal. This amount of steam must be branched off of the circuit and is advantageously added to the distillation gases coming from the coke oven battery, as provided in German Patent Application No. P 2 647 079.1. It is advisable to heat the inert combustion gases again prior to feeding them into the transportation ways of the preheated coal, in order to securely prevent any precipitation of moisture on the coal.

The combustion gas which is used as an inert gas is advantageously cooled, for precipitating the water contained therein, by heat exchange, and the cooled combustion gas, free from water, is then heated again by the not yet cooled combustion gases which still contain water. However, the drying may also be effected by means of any drying agent. Suitable for this purpose, for example, are silicic acid-based drying agents, such as silicagel. With the use of drying agents of this kind, it may be necessary to provide a preliminary cooling of the combustion gases.

To produce the combustion gases, a fuel which is poor in sulfur is preferably used for reasons which are well known. However, gaseous or liquid fuels, for example, so-called liquid petroleum gases, may also be used, because of their easy handling. Combustion gases which produce no steam or only little steam during combustion, such as gases poor in hydrocarbons and hydrogen and rich in carbon oxides, for example top gas, are also particularly suitable since drying of the gases can then be largely omitted. Also beneficial to the economy of the method is the use of the fine coal dust obtained in the coal drying process itself in the separators and filters, for heating the drying gas and producing the covering protective gas. In this way, a part of the entire amount of this ultrafine coal dust which preferably, and as a precaution, should not be supplied to the oven chambers, is purposefully used in the process itself. Should this fine coal dust be filled into the oven chambers along with the other coal, undesirable dust would develop in the chambers and clogging would occur in the passageways of the distillation gases.

A small oxygen content in the waste gases is harmless for use in the inventive method. However, this content should not exceed 4% by volume. The combustion may also be conducted with a deficiency in oxygen or air, to ensure a small oxygen content in the waste gas. The heating of the drying and heating gases, as well as the drying and heating of the coal itself, may be effected in one or several stages.

Accordingly, it is an object of the invention to provide a method of operating a coal predrying and heating plant in connection with a coking plant or for preparing and delivering coal to a coking plant, wherein, the coal is conveyed to the plant on a moving conveyor and which includes burning a fuel with air to produce a substantially inert combustion gas which is directed over the coal being conveyed to preheat the coal and to form an inert layer of gases thereover and, wherein, the gases which are passed over the coal are then subjected to cooling in order to remove the moisture therefrom, and a portion of these gases may be returned to pass over the coal being conveyed.

A further object of the invention is to provide a method of preparing coal for a coke oven which includes forming an inert gas by combustion of air and fuel, passing the inert gas which is formed over the coal as it is conveyed to the coking plant, and wherein, the inert gases may be formed by burning the coal itself and the coal may be preheated or predried by a separate gas which is passed in heat exchange relationship to the generated inert gas and then is passed over the coal to preheat it and predry it.

The various features of novelty which characterize the invention are pointed out with particularity in the claims annexed to and forming a part of this disclosure. For a better understanding of the invention, its operating advantages and specific objects attained by it uses, reference is made to the accompanying drawings and descriptive matter in which preferred embodiments of the invention are illustrated.

DESCRIPTION OF THE PREFERRED EMBODIMENTS

Figure 1:
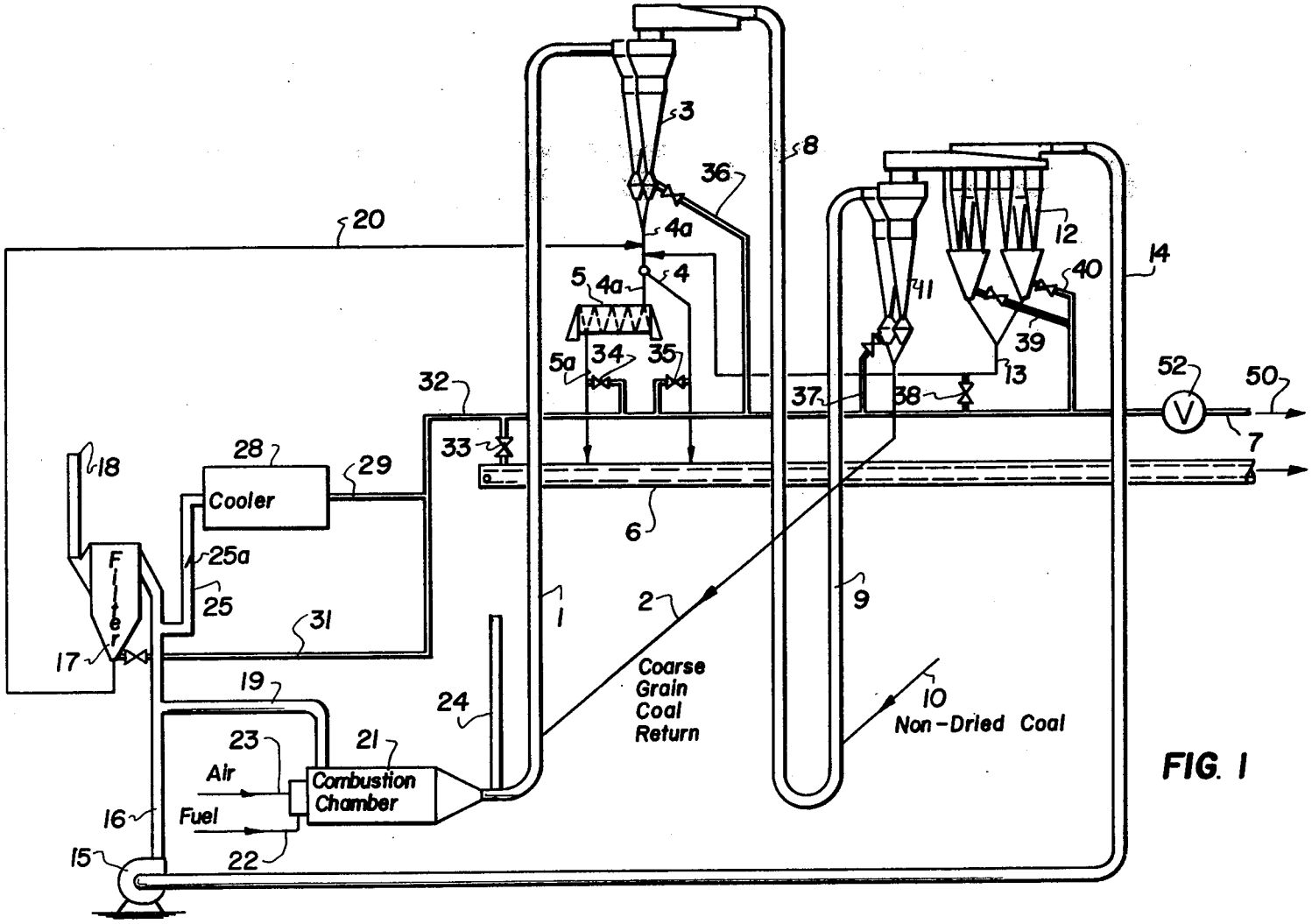
FIG. 1 is a schematic diagram of a plant showing the method of operating the coal predrying and heating plant in connection with a coking plant where inert gases are generated directly in a combustion chamber.

Referring to the drawings in particular, the invention embodied therein, comprises, a method of operating a coal predrying and heating plant in connection with a coking plant or for preparing and delivering coal to the plant. FIG. 1 relates to the inventive method providing a direct heating for the circuit of the predrying and heating plant and producing the inert gas to be used on the ways of transportation to the coke oven battery. Two tandem-connected flasher drier tubes 1 and 9 are provided. The non-dried coal is introduced through a transfer inlet 10. Tube 9 is the first stage and tube 1 is the second stage. The inert gas with a temperature of about 550° C., needed for the preheating and drying of the coal, is produced in a combustion chamber or furnace 21 into which a fuel is fed through a line 22 and combustion air through a line 23.

Up to the reaching of the operating temperature, the combustion gas is evacuated through a stack 24. As soon as the operating temperature is reached, the inert combustion gas is introduced into the flash drier tube 1 wherefrom it passes through a separator system 3, a down pipe 8, flash drier tube 9, a coarse grain separator system 11 to which a coarse grain return line 2 to the flash drier tube 1 is connected, a fine dust separator system 12, a return pipe 14, to be directed by a blower 15 through a line 16 and/or through a line 19 back into combustion furnace 21. The amount of inert gas in excess serves to satisfy the need of inert gas in the plant, to be used for the transportation of the dried and heated coal to the coke oven battery or the hot bunker servicing the battery.

To this end, the inert gas is removed through a line 25 equipped with a throttle control 25*a*. The gas is cooled, dried and freed from condensate in a cooler or dehumidifier apparatus 28 and directed through lines 29 and 32 to the locations where it is required, as shown by the arrow 50, and it can be shut off by a valve 52. Such required locations include the separator system 3 through a line 36; through an outlet line 4*a*, 4 of separator system 3 leading to the coal transportation system 6 (line 35), and the outlet line 5*a* of a coal wetting device 5 (line 34) in which, if necessary, the coal can be wetted with an oily dust-trapping agent.

Further required locations are the coarse grain separator system 11 (line 37), the fine dust separator system 12 (lines 39, 40), a line 13 (line 38) for transferring the dust into line 4*a*, and the hot coal bunker group (not shown, line 7). The coal which is preheated to about 130° C. and covered by the inert gas which has a temperature of about 210° C. is transported by means of the device 6. Further, through a line 31, the inert gas is supplied to the outlet of an electrostatic filter 17. The electrostatic filter 17 is connected to line 16 and receives an amount in excess of the inert gas needed neither for the drying and preheating of the coal for the protection thereof during transportation. Finally, the inert gas in excess, freed from coal dust, is evacuated through a stack 18 into the outer atmosphere, while the separated dust, protected by the inert gas supplied through line 31, is directed through a line 20 into line 4*a*, wherefrom, it again passes either into wetting device 5 or indirectly to the transportation system 6.

This direct method provides a high thermal efficiency due to the direct heat removal from combustion furnace 21 and to the low waste gas temperature (of about 130° C.) with a water vapor content of 40% at most. Preferred fuels for the combustion furnace 21 are ones that leave no solid residues during combustion.

Figure 2:
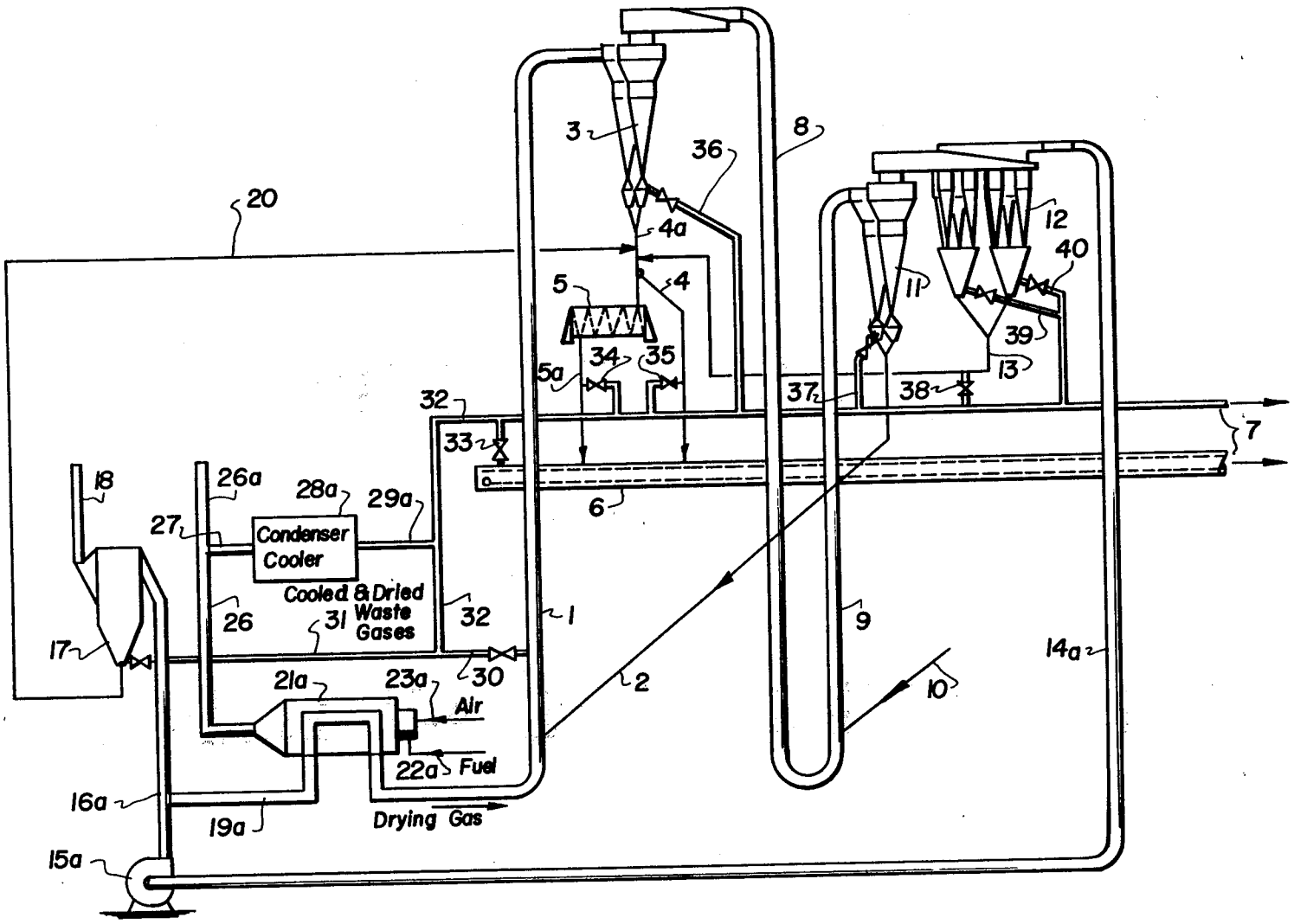
FIG. 2 is a view, similar to FIG. 1, indicating the indirect heating of the gases for treating the coal.

FIG. 2 relates to a modification of the method in which the coal is dried and preheated by means of steam with identical parts being shown by identical numbers. The steam is heated indirectly and the heat is produced by burning a fuel. The combustion gases thereby obtained are used as inert gases for protecting the coal during transportation.

At the start of the operation, in the arrangment of FIG. 2, as far as possible, a fuel is used which leaves no solid residues. During normal operation conditions, however, a fuel which does leave solid residues may be used. For this purpose, the apparatus 28*a* serving for cooling (heat exchange) and condensing the water from the combustion gases, is further provided with a filter for separating solid residues of fuel. The fuel is fed into a heater 21*a* through a line 22*a* and the combustion air through a line 23*a* and the fuel is burned. The combustion gases escape through a stack 26 which is equipped with a control flap 26*a*. For the start, waste gas is removed from line 26 and directed, through a line 27, to cooling and drying apparatus 28*a*. Cooled and dried waste gas passes through lines 29*a* and 32, as well as through line 30 which can be shut off, into the coal drying and preheating system which has been described above. The gas returns through lines 14*a*, 16*a* and blower 15*a* and is allowed to escape through electrostatic filter 17 and stack 18 to the free atmosphere.

As soon as the entire plant assumes the operating temperature and other operating conditions, the introduction of the moist coal to be coked into the drying and heating system through transfer inlet 10, and the supply of inert gas to the above described coal separating and transportation systems, as well as the gas circulation through the drying and heating system through lines 19*a* and indirect heater 21*a* are started. The amount of the drying and heating gas which is circulated is now increased by the steam proportion originating in the coal to be dried, and to the same proportion, the amount of inert gas introduced into the drying and heating system through line 30 is reduced, until finally, in full operation, substantially pure steam is in circulation.

This also is the instant at which heater 21*a* may be switched to an operation with a solid fuel, for example, coal dust supplied from electrostatic filter 17 or dust separator 12. Substantially only the water vapor newly formed during the coal drying then escapes through stack 18. However, the water vapor removed from the coal dust in electrostatic filter 17 may also be added to the distillation gas of the preheated coal, again in accordance with German Patent Application No. P 2647 079.1. The amount of this vapor corresponds to the moisture content of the coal prior to the treatment.

Particularly advantageous in this indirect heating of the coal drying gas is the possibility of using the coal dust produced in this plant itself. Due to the increased steam content in the crude distillation gas, the heat capacity of the latter is also substantially increased, which is a favorable condition for the separation of aqueous and tarry condensats from the crude distillation gases.

In both modifications of the inventive method, it is advantageous to design the coolers accommodated in apparatus 28 or 28*a* as heat exchangers in which the hot gases arriving through lines 25 or 27 transfer their heat to the inert gases which have been freed from water vapor and leave through lines 29 or 29*a*.

While specific embodiments of the invention have been shown and described in detail to illustrate the application of the principles of the invention, it will be understood that the invention may be embodied otherwise without departing from such principles.

What is claimed is:

1. A method of preparing and delivering coal to a coking plant comprising the steps of: generating hot inert combustion gases by burning a fuel in the presence of air, circulating said hot inert combustion gases over coal whereby said coal is dried and preheated; cooling a portion of said inert combustion gases subsequent to the drying and preheating of said coal to substantially remove moisture absorbed by said hot inert gases in preheating the coal and to lower the temperature thereof, and directing the substantially moisture reduced cooled inert combustion gases over the preheated coal being conveyed for further processing to the coking unit.

2. A method as defined in claim 1, including the steps of directing another portion of said inert combustion gases subsequent to the drying and preheating of said coal back to the combustion chamber in which said hot inert gases are generated.

3. A method as defined in claim 2, wherein said other portion of said inert combustion gases are not subjected to the cooling step of said first mentioned portion.

4. A method as defined in claim 1, including the step of separating any fine coal picked up in said inert combustion gases during preheating of said coal and returning any fine coal separated from said inert combustion gases to the combustion chamber for use as fuel to generate additional hot inert combustion gases.

5. A method of preparing and delivering coal to a coking plant comprising the steps of generating a hot inert gas by heat exchange with inert products of combustion generated by burning a fuel in the presence of air, directing the generated hot inert gas in heat exchange relationship with coal to effect the drying and preheating of said coal, cooling a portion of the inert products of combustion to remove moisture therefrom and to lower the temperature thereof, and conveying said cooled inert products of combustion into communication with said dried and preheated coal to form a protective inert cover for said dried and preheated coal being delivered to the coking plant.

6. A method as defined in claim 5, wherein the generated hot inert gas is steam.

7. A method as defined in claim 5, wherein said hot inert gas is generated in indirect heat transfer relationship to said products of combustion, and maintaining said hot inert gas in separate circuit from said products of combustion whereby said inert gas is utilized for preheating and drying coal, and circulating said products of combustion over said preheated coal to form a protective non-oxidizing cover for said preheated coal as said preheated coal is being conveyed for further processing.

8. A method of preparing and delivering coal to a coking plant comprising the steps of generating inert products of combustion by burning fuel in the presence of air, circulating said inert products of combustion over the coal to thereby preheat and dry the coal cooling a portion of said inert products of combustion to remove moisture therefrom, then heating said cooled portion of said inert products of combustion, and then circulating said cooled products of combustion over the coal being conveyed to a coking oven whereby said cooled inert products of combustion form a protective non-oxidizing cover for said coal being conveyed.

* * * * *